US010371080B2

(12) United States Patent
Franz

(10) Patent No.: US 10,371,080 B2
(45) Date of Patent: Aug. 6, 2019

(54) METHOD AND DEVICE FOR INSPECTING AN OXYGEN SENSOR

(71) Applicant: GM GLOBAL TECHNOLOGY OPERATIONS LLC, Detroit, MI (US)

(72) Inventor: Manuel Franz, Rüsselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 65 days.

(21) Appl. No.: 15/604,188

(22) Filed: May 24, 2017

(65) Prior Publication Data

US 2017/0342932 A1 Nov. 30, 2017

(30) Foreign Application Priority Data

May 24, 2016 (DE) ..... 10 2016 006 328

(51) Int. Cl.

| | |
|---|---|
| ***F02D 41/22*** | (2006.01) |
| ***F02D 41/02*** | (2006.01) |
| ***F02D 41/14*** | (2006.01) |
| ***F02D 41/26*** | (2006.01) |
| ***F02D 41/00*** | (2006.01) |

(52) U.S. Cl.

CPC ..... *F02D 41/222* (2013.01); *F02D 41/008* (2013.01); *F02D 41/0295* (2013.01); *F02D 41/1445* (2013.01); *F02D 41/1454* (2013.01); *F02D 41/1495* (2013.01); *F02D 41/26* (2013.01)

(58) Field of Classification Search

CPC ..... F02D 41/008; F02D 41/0295; F02D 41/1445; F02D 41/1454; F02D 41/1495; F02D 41/222; F02D 41/26

See application file for complete search history.

(56) References Cited

U.S. PATENT DOCUMENTS

| | | | | | |
|---|---|---|---|---|---|
| 5,099,647 | A * | 3/1992 | Hamburg | F01N 11/007 | 123/691 |
| 5,423,203 | A * | 6/1995 | Namiki | F02D 41/1495 | 123/688 |
| 5,724,953 | A * | 3/1998 | Jung | F02D 41/068 | 123/688 |
| 5,941,918 | A * | 8/1999 | Blosser | F01N 11/00 | 701/31.7 |

(Continued)

FOREIGN PATENT DOCUMENTS

| | | | | |
|---|---|---|---|---|
| DE | 102007045984 A1 * | 4/2009 | F02D 41/14 | |
| JP | 2007193952 A * | 8/2007 | H01M 8/04 | |

OTHER PUBLICATIONS

German Patent Office, German Search Report for German Application No. 102016006328.9, dated Dec. 6, 2016.

*Primary Examiner* — Marguerite J McMahon

*Assistant Examiner* — Teuta B Holbrook

(74) *Attorney, Agent, or Firm* — Lorenz & Kopf, LLP

(57) ABSTRACT

A method is disclosed for detecting a malfunction of an oxygen sensor in the exhaust gas system of an internal combustion engine having several cylinders. The cylinders are operated at the same air-fuel ratio and the resultant first output signal of the oxygen sensor is monitored. The cylinders are operated at varying air-fuel ratios and the resultant second output signal of the oxygen sensor is monitored. The first and second output signals are compared to determine whether the oxygen sensor has malfunctioned.

15 Claims, 2 Drawing Sheets

(56) References Cited

U.S. PATENT DOCUMENTS

| | | | | |
|---|---|---|---|---|
| 5,996,337 | A * | 12/1999 | Blosser | F02D 41/0055 60/274 |
| 6,830,027 | B1 * | 12/2004 | Segawa | F02D 41/0087 123/198 F |
| 2002/0022921 | A1 | 2/2002 | Nakagawa et al. | |
| 2002/0108432 | A1 | 8/2002 | Maloney | |
| 2003/0024514 | A1 * | 2/2003 | Kitamura | F01N 11/007 123/672 |
| 2008/0181428 | A1 * | 7/2008 | Van Reck | H03G 9/005 381/86 |
| 2009/0112446 | A1 * | 4/2009 | Richardson | F02D 41/222 701/109 |
| 2009/0260419 | A1 * | 10/2009 | Maeda | F02D 41/0025 73/23.32 |
| 2011/0113756 | A1 * | 5/2011 | Yezerets | F01N 3/103 60/276 |
| 2011/0252767 | A1 * | 10/2011 | Lin | F01N 3/208 60/274 |
| 2012/0226424 | A1 * | 9/2012 | Adams | F01N 3/20 701/93 |
| 2014/0358355 | A1 * | 12/2014 | Zimmerschied | F02D 41/1495 701/31.1 |
| 2016/0160781 | A1 * | 6/2016 | Nagar | F02B 33/34 701/102 |

* cited by examiner

METHOD AND DEVICE FOR INSPECTING AN OXYGEN SENSOR

CROSS-REFERENCE TO RELATED APPLICATION

This application claims priority to German Patent Application No. 102016006328.9, filed May 24, 2016, which is incorporated herein by reference in its entirety.

TECHNICAL FIELD

The present disclosure pertains to a method and a device for detecting a malfunction of an oxygen sensor in the exhaust gas system of an internal combustion engine.

BACKGROUND

An oxygen sensor may be used in a control scheme for regulating the supply of air and fuel to the cylinders of the internal combustion engine in such a way as to enable low-emission, energy-efficient operation.

The oxygen sensors currently used in the exhaust gas systems of motor vehicles usually encompass a ceramic layer, which is in contact with the exhaust gas flow on one side and with air on the other side. The ceramic layer, which is permeable to oxygen ions in a hot state, includes an electrode on each side. The electrodes deliver the electrons required for generating the oxygen ions. A resultant voltage between the electrodes can be tapped as a measuring signal, which provides information about the oxygen content in the exhaust gas.

The reaction time of such an oxygen sensor depends on how fast a fluctuation of the oxygen concentration in the exhaust gas affects the concentration of oxygen ions in the membrane; deposits on the membrane that impede the exchange of oxygen between the membrane and exhaust gas flow or ambient air, or that are able to store oxygen and release it again after a delay, can greatly prolong the reaction time, thereby impairing the quality with which the air-fuel ratio is regulated given engine load fluctuations.

In order to recognize such a situation and potentially prompt a user of the motor vehicle to remedy the latter, it is known to switch over to the cylinders in a deceleration phase of the motor vehicle within a timespan of several seconds between the supply of clean air and a rich mixture, and acquire the reaction time of the sensor to this change.

Such an approach is not feasible in automatic transmissions, which, when the driver takes his or her foot off of the gas pedal, decouple the engine from the gearing instead of decelerating, since the interruption of fuel supply would cause the engine to stop.

It also makes no sense to execute the switchover between the supply of clean air and a rich mixture in a partial load operation as described above, since an interruption in the fuel supply or even a reduction therein would limit drivability in a manner very tangible to the driver, and operation with a rich mixture would result in high consumption and pollutant emissions.

SUMMARY

The present disclosure provides a method for detecting a malfunction of an oxygen sensor whose application is not limited to deceleration times, and which at most marginally impacts drivability, consumption and pollutant emissions. In an embodiment of the present disclosure, a method for detecting a malfunction of an oxygen sensor in the exhaust gas system of an internal combustion engine exhibiting several cylinders includes operating the cylinders at the same air-fuel ratio and monitoring a first output signal of the oxygen sensor, operating the cylinders at varying air-fuel ratios and monitoring a second output signal of the oxygen sensor, and comparing the first and second output signals to identify a malfunction state of the oxygen sensor. The method is based on the fact that an uneven fuel supply to the cylinders will lead to an output signal exhibiting high frequency noise given an intact, responsive oxygen sensor. Instead of rating the appearance of such noise as a symptom of a malfunction that must be remedied, however, an uneven supply to the cylinders is brought about in a targeted manner within the framework of the present disclosure, so as to rate this as an indicator for the proper function of the oxygen sensor if this expectedly leads to a noisy output signal.

The decision about the proper or improper function of the oxygen sensor can be made based on comparing the spectral composition of the output signals. In particular, the output signal of the oxygen sensor can for this purpose be subjected to high-pass filtering, and the oxygen sensor can be rated as malfunctioning if the intensity of the high-pass filtered output signal drops below a limit. This limit can be defined as fixed or proportional to the intensity of a low-frequency portion of the output signal.

Alternatively, the average value for a time derivative of the output signal can be determined, and the oxygen sensor can be rated as malfunctioning if this average value drops below a limit. While the time derivation considered for this purpose will most often be the first derivation, a higher derivation may also be implemented to rate a malfunctioning. Here as well, the limit can be defined as fixed or dependent on the signal, e.g., as proportional to the average value of the output signal.

Regulation of the air-fuel ratio based on the output signal of the oxygen sensor can be continued during the method. Resultant fluctuations in the output signal typically have a lower frequency than the noise caused by the uneven supply of the cylinders. These fluctuations can be separated from the noise generated by the uneven supply via the time derivation mentioned above or through high-pass filtering. A fluctuation in the output signal caused by the continued mentioned regulation of the air-fuel ratio can serve as a standard of comparison to decide whether a noise observed in response to an uneven supply of the cylinders is sufficient for assuming that the oxygen sensor is not malfunctioning.

During the constant air-fuel operation, each individual cylinder should be operated at a stoichiometric ratio. This is not possible during the variable air-fuel operation. However, given the lean operation of at least one cylinder and the rich operation of a cylinder, the stoichiometric ratio can be maintained on average over the entirety of cylinders, thereby still enabling a catalytic reduction of CO and nitrogen oxides that arise during combustion. In order to ensure that the noise can be smoothly observed, it is desirable to have the supply of at least one cylinder deviate strongly from another one. By contrast, the deviations in cylinder supply should be as slight as possible in order to avoid impairments to drivability. In practice, it is thus preferred that at least one of the cylinders be operated at an air-fuel ratio that deviates from the stoichiometric ratio in a range between 10 and 50%.

In order to acquire changes that arise during operation of oxygen sensor, the operation of the cylinders at varying air-fuel ratios and monitoring a second output signal of the oxygen sensor, and the comparison of the first and second output signals to identify a malfunction state of the oxygen sensor. should be cyclically repeated.

If the difference between the first and second output signals is strong enough to rule out the presence of a malfunction, then the difference between the air-fuel ratios of the cylinders can be diminished to benefit drivability when subsequently the process.

In another embodiment of the present disclosure, a device detects a malfunction of an oxygen sensor in the exhaust gas system of an internal combustion engine exhibiting several cylinders. The device is configured to selectively operate the cylinders at the same air-fuel ratio and at varying air-fuel ratios. The device is configured to monitor the resultant output signal of the oxygen sensor. The device is further configured to determine whether a malfunction is present by comparing the output signals obtained at the same air-fuel ratio and at varying air-fuel ratios.

The subject matter of the present disclosure further relates to a computer program product with program code enabling a computer to implement a method as described above or operate as a device as indicated above, as well as a computer-readable data carrier on which program instructions are recorded that allow a computer to operate in this manner

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
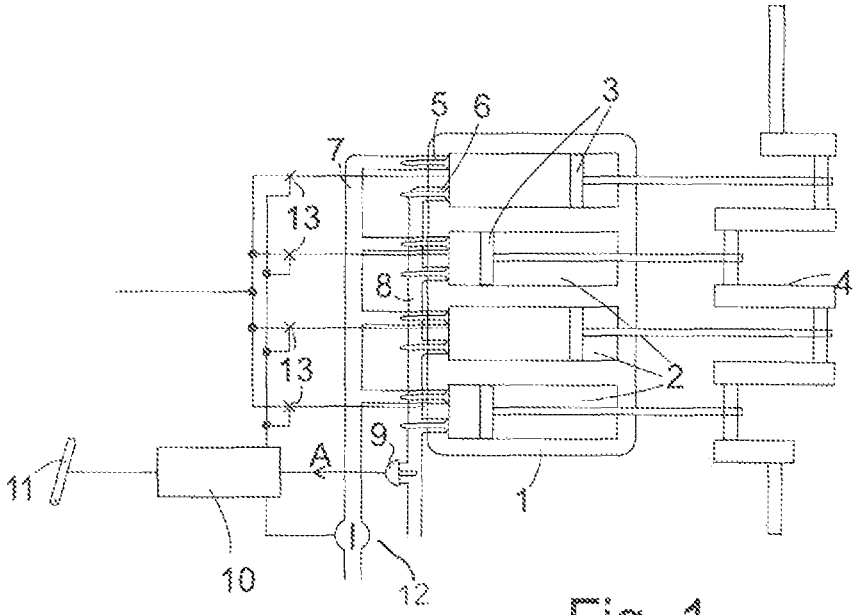
FIG. 1 is a schematic representation of an internal combustion engine with exhaust gas recirculation, to which the present disclosure may be applied.

FIG. 1 shows a block diagram of an internal combustion engine assembly for a motor vehicle. Depicted is an internal combustion engine 1, in particular a gasoline engine, with four cylinders 2 in the example herein presented, in which pistons 3 can be displaced for driving a crankshaft 4. Each cylinder 2 has two or four valves 5, 6 actuated by a camshaft (not shown) at half the rotational frequency of the crankshaft 4. Valves 5 join the cylinder 2 with an intake manifold 7, and valves 6 join the cylinder 2 with an exhaust manifold 8.

Mounted on a downstream end of the exhaust manifold 8 is an oxygen sensor 9 configured to acquire the oxygen content in an exhaust gas from the engine 1. An electronic control unit or ECU 10 is generally configured to control the operation of the internal combustion engine 1. For example, the ECU 10 controls the position of a throttle valve 12 in the intake manifold 7 as well as fuel metering to the cylinders 2 based upon the position of a gas pedal 11. The ECU is also configured to receive output signals from the oxygen sensor 9 and any other potential parameters.

In normal operation, the injected fuel quantity is the same for all cylinders 2. Since the output signal A of the oxygen sensor 9 changes greatly at the boundary between the rich and lean mixture, regulating the output signal A to a constant value is difficult, but not necessary for operating the engine with a stoichiometric mixture composition. It is sufficient for the ECU 10 to increase the air-fuel ratio by a small increment every time the output signal A of the oxygen sensor 9 indicates a rich mixture, and again correspondingly decrease the latter given a lean mixture.

Figure 2:
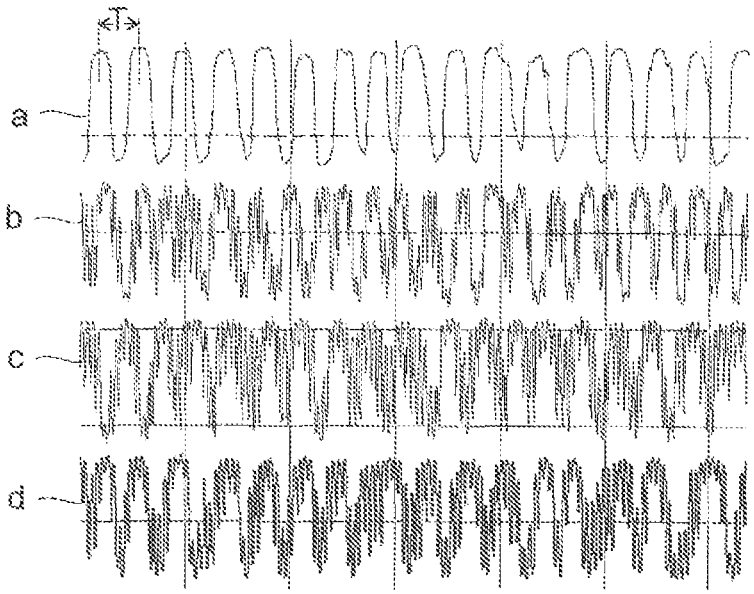
FIG. 2 is the output signal of the oxygen sensor of the internal combustion engine on FIG. 1 when operating all cylinders at the same air-fuel ratio and when operating individual cylinders at a varying air-fuel ratio.

In order to quickly and correctly react to abrupt load changes, the reaction time of the oxygen sensor 9 must be distinctly shorter than the period T of this oscillation. Whether it actually has done so or whether the oxygen sensor 9 has slowed due to contamination or for some other reason cannot be ascertained based on curve a shown in FIG. 2. In order to verify the proper functionality of the oxygen sensor 9, the ECU 10 may be configured to implement the algorithm illustrated in FIG. 3 as a flowchart.

At block S1, the engine 1 runs in the normal operating mode, i.e., the ECU 10 actuates injection valves 13 of all cylinders 2 in such a way that the injection quantity is the same for all cylinders 2, and narrowly oscillates around the stoichiometric ratio. The oxygen sensor 9 delivers an output signal A as depicted on curve a of FIG. 2. The ECU 10 acquires the amplitude ($A_N$) of this output signal.

At block S2, the ECU 10 changes the injection quantity for one of the cylinders 2 in the rich direction. The particular cylinder adjusted can be determined anew each time the method is repeated. The injection quantity is simultaneously reduced for one or all other cylinders 2 to a point where the air-fuel ratio averaged for all cylinders 2 remains unchanged. In other words, if the injection quantity is raised by an exemplary percentage $\delta$ of 30% for one of the here n=4 cylinders 2 of the engine on FIG. 1, it is simultaneously reduced for a second one by the same percentage, and remains unchanged for the remaining cylinders. Alternately, the injection quantity is reduced for all n−1 other cylinders by $\delta/(n-1)$, i.e., by 10% each. As evident from curve b, curve c and curve d in FIG. 2, the result of this measure in both the former and latter case is that, once the oxygen sensor 9 has the necessary reaction rate, the oscillation of the output signal is superposed by noise in a frequency range distinctly above the oscillation frequency of curve a. The output signal A(t) resulting from the change in the air-fuel ratio is recorded for a period of time at block S3.

In a first embodiment of the method, the output signal A(t) recorded at block S3 is subjected to high-pass filter at block S4 in order to extract the noise component. After data acquisition, a switch is again made to uniform fuel supply to all cylinders 2 at block S5.

At block S6, the amplitude $A_R$ of the noise component is compared with the amplitude $A_N$ obtained at block S1. If the noise amplitude $A_R$ remains below a limit $cA_N$ obtained by multiplying the amplitude $A_N$ by a prescribed factor c, it can be concluded that the oxygen sensor 9 has malfunctioned, and should be serviced or replaced to ensure an energy-efficient and low-emission engine operation. A related warning may be output at block S9. If the noise amplitude $A_R$ lies above the limit $cA_N$, the oxygen sensor 9 is operating properly, and the method ends without any other measures.

Block S1 can be omitted if not just the high-frequency noise, but also the low-frequency residue is separated from the output signal A(t) recorded at block S3. This residue essentially approximates the output signal obtained at block S1, and can thus also be used to extract the normal operating amplitude $A_N$ therefrom.

Figure 3:
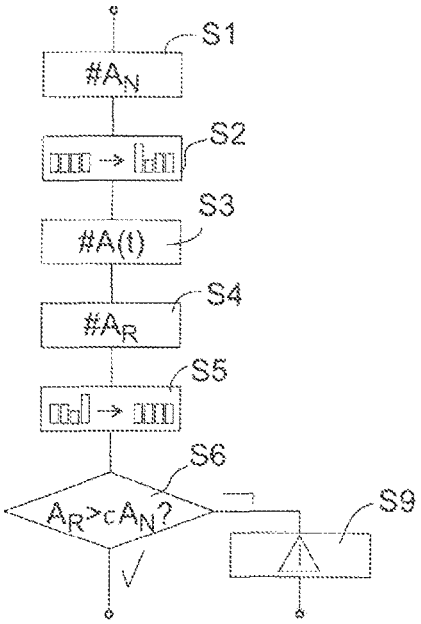
FIG. 3 is a flowchart of a method according to a first embodiment of the present disclosure.

In an variant of the method, the output signal A of the oxygen sensor 9 is derived by time at block S1 while the engine runs in the normal operating mode, and the amplitude $A_N$ of this derivation (dA/dt) is recorded. Blocks S2 and S3 are the same as described above. The high-pass filtering indicated at block S4 in FIG. 3 is replaced by the generation of the time derivation. When the output signal A(t) is properly distorted owing to the non-uniform supply of the cylinders 2, the latter has an amplitude $A_R$ that is distinctly higher than $A_N$, so that the oxygen sensor 9 is here also deemed to malfunction if $A_R$ is less than the product of $A_N$ and a prescribed factor c. A related warning may be output at block S9. If the noise amplitude $A_R$ lies above the limit $cA_N$, the oxygen sensor 9 is operating properly, and the method ends without any other measures.

Figure 4:
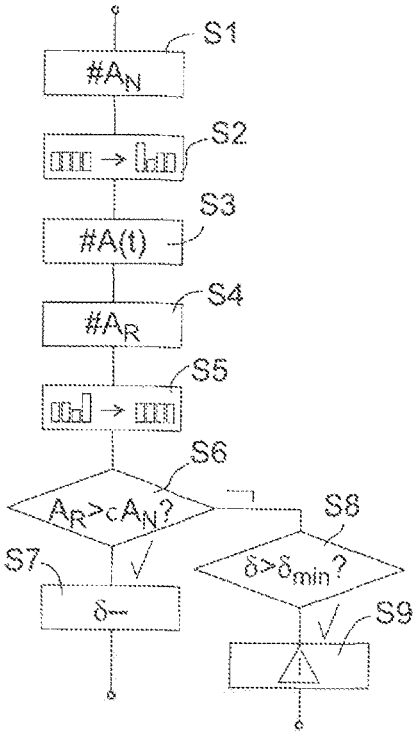
FIG. 4 is a flowchart according to a second embodiment.

In order to lessen the impact of the method on the performance of the engine 1 as much as possible, and possibly prevent the driver of the vehicle from noticing that the method is being implemented, it is desirable that the uneven supply of the cylinders 2 set in S3 be kept as slight as possible. The flowchart on FIG. 4 presents one option for accomplishing this. Blocks S1-S6 of this method is the same as in the method on FIG. 3. If it is determined at block S6 that $A_R>A_N$, the percentage δ is decremented at block S7, so that if the method is repeated at a later point in time, there are less differences in the fuel supply to the cylinders 2.

After repeating the method several times, this inevitably results in $A_R>A_N$ no longer being satisfied, even given a properly functioning oxygen sensor 9. In this case, a check is initially performed for this case at block S8 to determine whether the percentage δ is at least equal to a minimum value $\delta_{min}$ necessary for reliably evaluating sensor function. Should this be the case, a warning is output at block S9. In the opposite case, δ is increased, and the method goes back to block S2, so as to set the distribution of fuel according to the changed percentage δ, and the measurement S3 and evaluation S4 based thereupon are repeated.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for detecting a malfunction of an oxygen sensor in an exhaust gas system of an internal combustion engine having a plurality of cylinders comprising:

(a) operating the internal combustion engine such that each cylinder is provided with an equivalent air-fuel ratio;

(b) monitoring the oxygen sensor to obtain a first output signal during the operating of the internal combustion engine with each of the plurality of cylinders provided with the equivalent air-fuel ratio;

(c) operating the internal combustion engine such that a first one of the plurality of cylinders is provided with a higher air-fuel ratio than a remainder of the plurality of cylinders and a second one of the plurality of cylinders is provided with a reduced air-fuel ratio than the remainder of the plurality of cylinders;

(d) monitoring the oxygen sensor to obtain a second output signal during the operating of the internal combustion engine with the first one of the plurality of cylinders provided with the higher air-fuel ratio and the second one of the plurality of cylinders provided with the reduced air-fuel ratio than the remainder of the plurality of cylinders; and (e) determining a sensor malfunction based on a comparison of the first and second output signals.

2. The method according to claim 1, wherein determining a sensor malfunction comprises comparing a spectral composition of the first and second output signals.

3. The method according to claim 1, further comprising high-pass filtering the second output signal and determining the sensor malfunction when an amplitude of the high-pass filtered second output signal is less than a limit.

4. The method according to claim 3, further comprising determining the limit by multiplying an amplitude of the first output signal by a predetermined factor.

5. The method according to claim 1, further comprising determining an average value for a time derivative of the second output signal and determining the sensor malfunction when the average value drops below a limit.

6. The method according to claim 5, further comprising determining the limit by multiplying an amplitude of the first output signal by a predetermined factor.

7. The method according to claim 1, further comprising regulating the air-fuel ratio during (a) based on the first output signal.

8. The method according to claim 1, further comprising regulating the air-fuel ratio during (c) based on the second output signal.

9. The method according to claim 8, wherein during (c) a stoichiometric ratio is maintained on average over the plurality of cylinders.

10. The method according to claim 9, further comprising operating the second one of the plurality of cylinders at an air-fuel ratio that deviates in a range between 10% and 50% from the stoichiometric ratio.

11. The method according to claim 1, further comprising cyclically repeating (c) through (e).

12. The method according to claim 11, further comprising diminishing a difference between the air-fuel ratios of the cylinders when the sensor malfunction has been ruled out in (e) when cyclically repeating (c).

13. The method according to claim 1, further comprising issuing a warning when the sensor malfunction has been determined.

14. A non-transitory computer-readable data carrier comprising with program code having instruction that allow a computer to implement the method according claim 1.

15. A device for detecting a malfunction of an oxygen sensor in an exhaust gas system of an internal combustion engine having a plurality of cylinders comprising an electronic control unit configured to:

(a) operate the internal combustion engine such that each cylinder is provided with an equivalent air-fuel ratio;

(b) monitor the oxygen sensor to obtain a first output signal during the operation of the internal combustion engine with each of the plurality of cylinders with the equivalent air-fuel ratio;

(c) operate the internal combustion engine such that a first one of the plurality of cylinders is provided with an increase in air-fuel ratio by a value such that the first one of the plurality of cylinders has an air-fuel ratio that is greater than a remainder of the plurality of cylinders and a second one of the plurality of cylinders is provided with a decrease in air-fuel ratio by the value such that the second one of the plurality of cylinders is provided with an air-fuel ratio that is less than the remainder of the plurality of cylinders;

(d) monitor the oxygen sensor to obtain a second output signal during the operation of the internal combustion engine with the first one of the plurality of cylinders with the increase in the air-fuel ratio and the second one of the plurality of cylinders with the decrease in the air-fuel ratio;

(e) determine a sensor malfunction based on a comparison of the first and second output signals;

based on a determination that the sensor is operating properly, decrease the value;

repeat (a)-(e) and based on a determination that the sensor is malfunctioning, determine whether the value is greater than a minimum value; and based on a determination that the value is greater than the minimum value, output a warning.

* * * * *